United States Patent [19]

Fitzpatrick et al.

[11] 4,395,038

[45] Jul. 26, 1983

[54] TELESCOPING AIR JETS FOR PILING

[75] Inventors: Donald C. Fitzpatrick, Chatham, N.Y.; Gerald A. Guild, Dalton; Arthur T. Karis, Lenox, both of Mass.

[73] Assignee: Beloit Corporation, Beloit, Wis.

[21] Appl. No.: 306,736

[22] Filed: Sep. 29, 1981

Related U.S. Application Data

[63] Continuation of Ser. No. 113,722, Jan. 21, 1980, abandoned.

[51] Int. Cl.[3] ..... B65H 29/24

[52] U.S. Cl. ..... 271/195; 271/211; 271/309; 414/903

[58] Field of Search ..... 271/195, 211, 224, 309; 414/69, 903

[56] References Cited

U.S. PATENT DOCUMENTS 2,261,972 11/1941 Matthews ..... 271/195
3,727,911 4/1973 Vits ..... 271/195
3,971,554 7/1976 Stange .

FOREIGN PATENT DOCUMENTS 2427280 12/1975 Fed. Rep. of Germany .
2009714 6/1979 United Kingdom .

*Primary Examiner*—Richard A. Schacher
*Attorney, Agent, or Firm*—Hill, Van Santen, Steadman, Chiara & Simpson

[57] ABSTRACT

A piling assembly for a sheet stacker utilizes air pressure to corrugate a paper sheet for stiffness and to transport the sheet from a conveyor onto a pile formed against a backstop. The assembly is comprised of a plurality of telescoping rods which overlie the sheet pile and issue air jets in a downward and lateral direction onto the upper surface of a sheet. The mechanism further includes a lift means situated beneath the sheet and directing air against the undersurface of the sheet, so that the sheet can float over the pile as the sheet is jogged against the backstop in the stacker. The backstop is made movable and the telescoping rods are adjustable to accommodate various lengths of sheet in the stacker.

13 Claims, 4 Drawing Figures

TELESCOPING AIR JETS FOR PILING

This is a continuation application of commonly assigned Ser. No. 113,722, filed Jan. 21, 1980, and now abandoned.

BACKGROUND OF THE INVENTION

1. Field of the Invention

The invention relates to a method and means for handling successive sheets to be stacked in a pile.

2. Description of the Prior Art

A stacker station is utilized in a conventional paper making production line to arrange paper sheets into reams. Typically, paper sheets, or clips, issue from a sheeting machine which shears the sheets from a continuous paper web. The sheets are advanced in seriatim fashion along a conveyor system to the stacker, where the sheets are piled.

Good piling requires that the sheets be jogged against a reference. The stacker is provided with a backstop to act as the jogging reference. The problem presented by piling is enabling each successive sheet delivered by the conveyor system to be pushed from the upstream end of the pile over the top of the pile all the way to the backstop without engaging the sheet immediately below it. A sheet which buckles or curls on its way to the backstop will not jog properly and can in some cases be driven over the backstop. In such instances, the ream is ruined and stacker operation may have to be reset, thereby generating loss in production time.

One present method attempting to solve this problem has been to employ corrugating rolls for stiffening the successive sheets. The rolls are mounted at the upstream end of the stacker to give U-shaped corrugations to each sheet passing into the stacker. The U-shaped corrugations give stiffness to the sheet allowing it to be pushed without buckling. However, the height of the corrugations must be accommodated by a differential in elevation between the sheet being delivered and the top of the pile. This differential usually represents a large drop off, which enhances roll-over or buckling as the sheet is applied to the pile.

Another common practice for piling sheets in a stacker has involved air flotation. A typical air flotation device directs air against the undersurface of a sheet as it begins to pass over the pile such that it floats over the pile to jog with the backstop. By the time the sheet reaches the backstop the air pressure beneath the sheet must have dissipated so that the sheet drops onto the pile. However, air directed in this fashion frequently fails to reach the leading edge of the sheet, causing the sheet to buckle before it reaches the backstop. Also, the air has a tendency to hold the tail of the sheet up, making piling and jogging against a reference difficult.

An important object of the present invention is to provide a new and improved method of and means for handling paper sheets to pile in a stacker which will avoid the disadvantages, inefficiencies, shortcomings, and problems inherent in prior arrangements.

A further object of the present invention is to corrugate each sheet being propelled into the stacker for stiffness while, at the same time, permitting a short drop off into the pile.

Another object of the invention is to maintain each sheet level over the pile to a much more reliable degree than heretofore possible.

Still another object of the invention is to transport each sheet to the backstop in a high speed manner with a minimum of machine elements.

A still further object of the invention is to provide structure which accommodates different size sheets in the stacker.

Other and further objects of this invention will be apparent to those skilled in the art from the following description of the annexed sheets of drawings showing a preferred embodiment of the invention.

SUMMARY OF THE INVENTION

Within the principles of the present invention, there is provided a piling assembly to convey each sheet off a conveyor system into jogging abutment with the backstop in a stacker and deposit the sheet onto a pile being formed in the stacker. The assembly directs flows of air against the sheet to transport it on its way. A lift means blows high volume ionized air along the undersurface of the sheet as it is conveyed into the stacker. A transporter means overlies the stacker and directs linear arrays of discrete jets of air in a downward and lateral fashion toward the backstop such that the jets issue against the upper surface of each newly delivered sheet. The upward force from the ionized air supports the delivered sheet out over the top of the pile. The jets act to form shallow corrugations in the sheet increasing its stiffness. At the same time, lateral force components due to the jets counteract with the natural frictional resistance of the sheet to move it towards the backstop. Upon abutment with the backstop, downward pressure from the overlying air jets builds in the form of static pressure. This downward pressure forces the sheet down onto the pile as the lift pressure dissipates.

The transporter means is arranged in the form of length-adjustable, telescoping rods which act as discharge ducts for the air jets. The rods take the form of progressively thinner stages. They are mounted in parallel and extend from the delivery end of the conveyor system into contact with the backstop which supports one end of the telescoping rods along their outermost final stages.

The backstop is made laterally movable to accommodate various lengths of sheet. Jet nozzles from which the pressurized air issues are located along transition walls between the telescoping stages along each rod. Hence, rod lengths can be adjusted without affecting the amount of air being directed from the transporter means; so, a balance of pressurized air forces and lift air forces is maintained despite adjustment of the stacker for different lengths of sheet.

DESCRIPTION OF THE PREFERRED EMBODIMENT

The referred embodiment is directed to the production of paper sheets and their arrangement into small piles or reams. It will be understood, however, that the principles of the present invention would be applicable to the gathering and stacking of other sheet material, such as board or cardboard.

Figure 1:
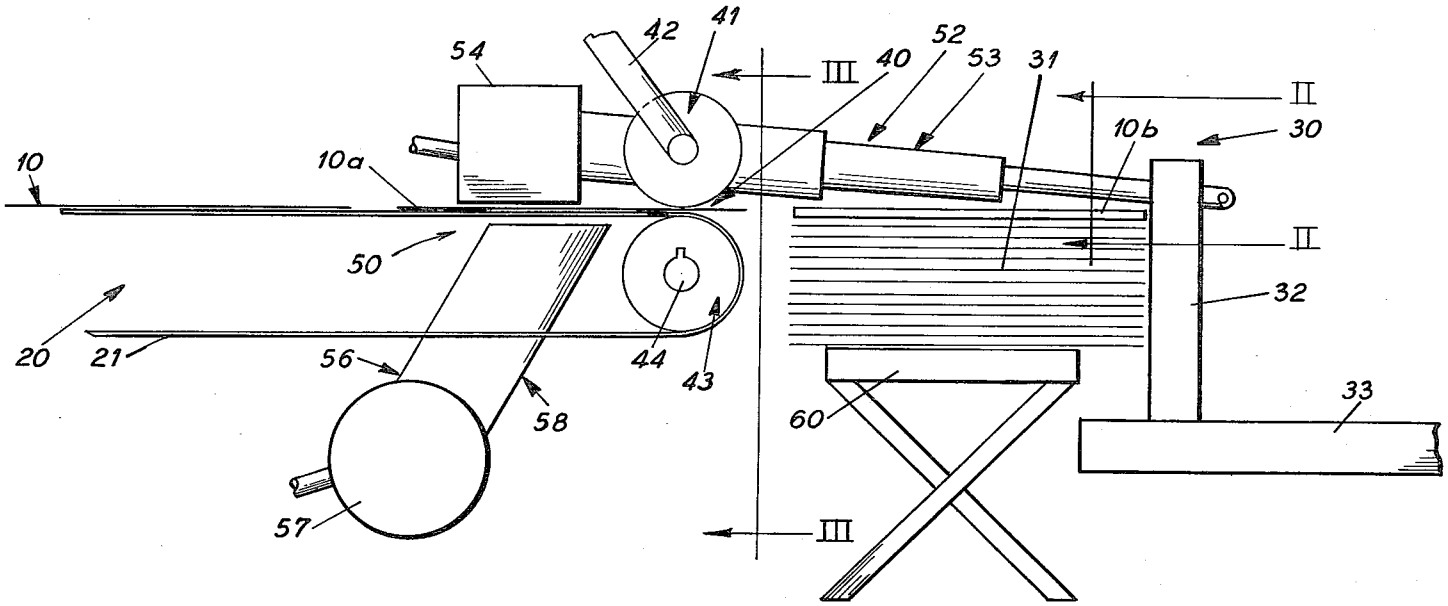
FIG. 1 is a side plan view of a stacker employing the piling mechanism of the present invention.
Figure 3:
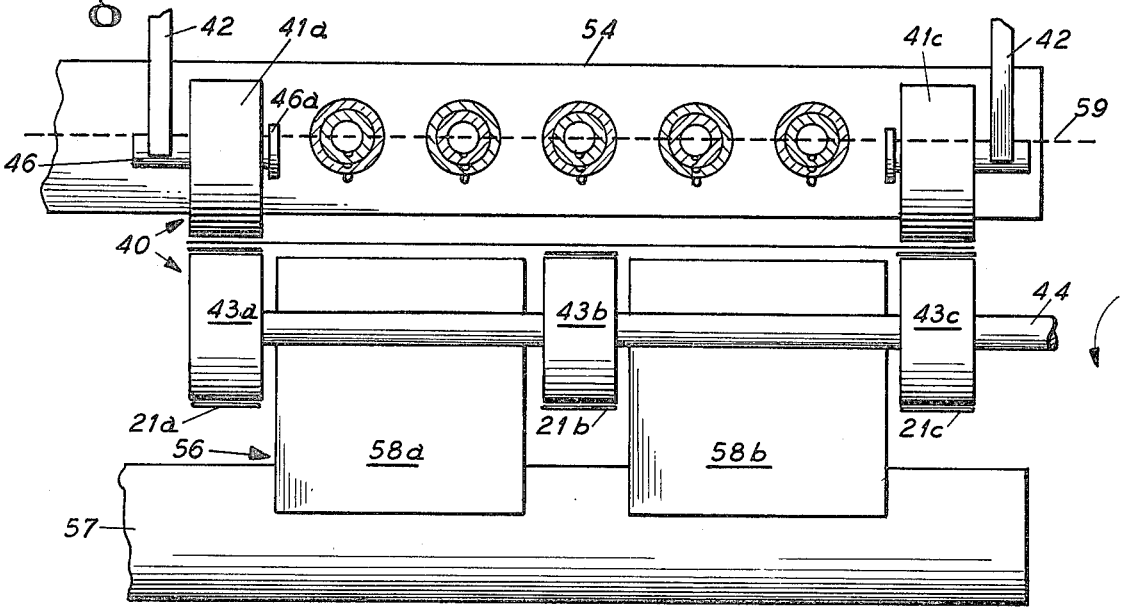
FIG. 3 is a front sectional view taken along the lines III—III of FIG. 1.

FIG. 1 shows a sheet stacker system employing the piling mechanism of the present invention. After sheets have been cut from a web of paper, the sheets, such as shown at 10, are fed in seriatim to the stacker 30 on a conveyor system 20. The conveyor system 20 includes delivery conveyor belt 21 being formed in the stacker 30 against a backstop 32. The delivery conveyor belt 21 is of a type which permits exposure of the sheets 10 from underneath the belt 21. For example, as shown in FIG. 3, it is contemplated that delivery belt 21 consists of a plurality of spaced apart ribbons 21*a,b* and *c*.

Kick-off roller means 40, consisting of upper 41 and lower 43 rollers, are located at the downstream end of the conveyor system 20 at a point just upstream of the sheet pile 31. The sheets 10 are successively advanced between the kick-off rollers 41, 43 towards the backstop 32, as is shown occurring to sheet 10*a* in FIG. 1, so as to maintain the sheet at the speed and in the direction of travel of the delivery conveyor belt 21 as the sheet is fed into the stacker 30. Lower kick-off roller means 43 acts as the downstream roller supporting the belt 21. Preferably, roller means 43 is, as shown in FIG. 3, comprised of a driven rod 44 having spaced therealong a plurality of raised wheel portions 43*a, b* and *c* over which ride respective ribbons 21*a, b* and *c* of the delivery belt 21. Between the raised wheel portions there is sufficient space for a flow of air as will be described below in connection with the lift means 56.

Mounted directly over roller means 43 are kick-off roller means 41. Roller means 41 are supported on arm means 42 pivoted from above so as to be able to float freely over the sheets 10 as they leave the conveyor 20. Kick-off roller means 41 press sheet 10*a* against the kick-off roller means 43. Preferably, two kick-off rollers comprise the kick-off roller means 41 and are utilized along the outer side areas of the delivery belt 21. As shown in FIG. 3, kick-off rollers 41*a* and 41*c* are supported directly over rollers 43*a* and 43*c*, respectively. Rollers 41*a* and 41*c* are each supported on stationary shafts 46, each having an integral abutment 46*a* at one end. The free floating support arm 42 engages shaft 46 between to the side of the roller 41*a*, 41*c* opposite the abutment 46*a*. It is contemplated that in assembling the kick-off roller means 41, a roller, for example 41*a*, will be mounted first upon shaft 46 in juxtaposition with the integral abutment 46*a*. The shaft 46 will then be connected to the support arm 42, such as by a weld arrangement.

A stacker 30 includes a platform 60 upon which a sheet pile 31 is formed. The platform 60 is a vertically reciprocable table, which for example, could be driven by hydraulic lifts. The platform 60 is arranged to travel downward at the same rate as the growth of the pile 31, thereby maintaining a constant delivery height for the top of the pile 31. The downward travel of the platform 60 is preferably related to the conveyor system 20 in such a manner that a change in the delivery speed of the sheets 10 will automatically alter the descent rate of the platform 60. Means for controlling the descent of platform 60 in this manner are known in the art as, for example, is described in British Patent No. 1,533,871, published Nov. 29, 1978.

The backstop 32 is mounted upon a track 33 in the stacker 30 so as to be laterally slidable towards or away from the kick-off roller means 40. The backstop 32 serves as a jogging reference or edge against which the sheet pile 31 is formed. The backstop 32 is made movable to allow for the stacker 30 to be used to pile different length sheets. As each sheet 10 leaves the delivery conveyor 21, it is advanced through the kick-off roller means 40 and transported by means of a piling assembly 50 over the pile 31 and into jogging abutment with the backstop 32, as shown by sheet 10*b* in FIG. 1. Upon engaging the backstop 32, the sheet 10*b* is deposited onto the pile 31 as platform 60 descends to accommodate the new sheet 10*b*.

The piling assembly 50 directs air pressure upon sheet 10*a* as it enters the stacker 30. The assembly 50 consists primarily of two air pressure mechanisms, namely, transporter means 52 and lift means 56.

As shown in FIG. 1, the lift means 56 serves to blow air upwardly from underneath each successive sheet as it approaches the kick-off roller means 41, 43. The lift means 56 is comprised of a manifold 57 supplied with pressurized air, for example, by means of a blower, not shown. The air is directed from the manifold 57 upwardly into contact with the undersurface of sheet 10*a* through discharge means 58, creating a generally static pressure lift force. Discharge means 58 consists of one or more ducts extending into the space or spaces between the ribbons of the delivery belt 21 such that the duct or ducts exhaust onto the areas of the sheet exposed from underneath the belt 21.

For purposes of the present embodiment, two discharge ducts 58*a* and 58*b* are utilized as shown in FIG. 3. The ducts 58*a*, 58*b* extend in the spaces between the lower kick-off wheels 43*a*, 43*b*, 43*c*. Air discharged from the ducts 58*a* and 58*b* serves to force sheet 10*a* upward as it passes through the kick-off roller means 41, 43. The air spaces between the raised wheel portions 43*a, b*, and c of the lower kick-off roller means 43 permit the pressurized air to remain in contact with the undersurface of the sheet as it passes out from the kick-off roller means 41, 43 and over the pile 31. As the sheet travels further out over the pile, and towards the backstop 32, air pressure continues to stay between the sheet and the top of the pile 31, although the pressure is quickly dissipating.

For the purposes of the instant inventions, it is contemplated that the air blown through the lift means 56 be ionized air, so as to neutralize the likely presence of static electricity. Static electricity in the instant sheet stacking arrangement would tend to resist separation of the sheets from the delivery conveyor 21 and could deflect the leading edge of a sheet toward the pile 31 causing buckling or curl. It is further contemplated that the air blown through the lift means 56 be directed at a relatively high volume to assure the presence of air pressure between the sheet and the top of the pile 31 all the way to the backstop 32, as shown by sheet 10*b* in FIG. 1. The high volume of lift air circumvents a problem plaguing prior air flotation arrangements wherein air pressure would be dissipated before the sheet reached its jogging reference, causing the sheet to curl down into the pile. Although air pressure blown through the lift means 56 will be low, it may in some cases be relatively higher than that utilized in prior air flotation arrangements. However, a relatively higher air pressure further assures the presence of air pressure beneath the sheet being delivered to the pile 31 as it travels to the backstop 32. Unlike prior air flotation arrangements, a high lift pressure does not obstruct deposit on the pile 31 in the present invention since the transporter means 52 provides a counteracting air pressure along the upper surface of the sheet.

The transporter means 52 operates in conjunction with the airlift means 56 to direct each successive sheet from the kick-off roller means 41–43 to the backstop 42. The transporter means 52 is supported on the stacker 30 in overlying relationship to the sheet pile 31. The system 52 is comprised of a plurality of length-adjustable, telescoping rods 53, which serve as discharge ducts for pressurized air. The rods 53 extend in parallel with each other in perpendicular relationship to said backstop 32 and open up into successive duct stages in the direction of conveyance of the sheets as they are fed from the delivery belt 21 into the stacker 30.

The figures illustrate a set of five, three stage telescoping rods 53 for use in the present embodiment; however, it will be apparent to those skilled in the art that telescoping rods of various stages, different numbers and assorted stage lengths are within the contemplation of the present invention.

Figure 4:
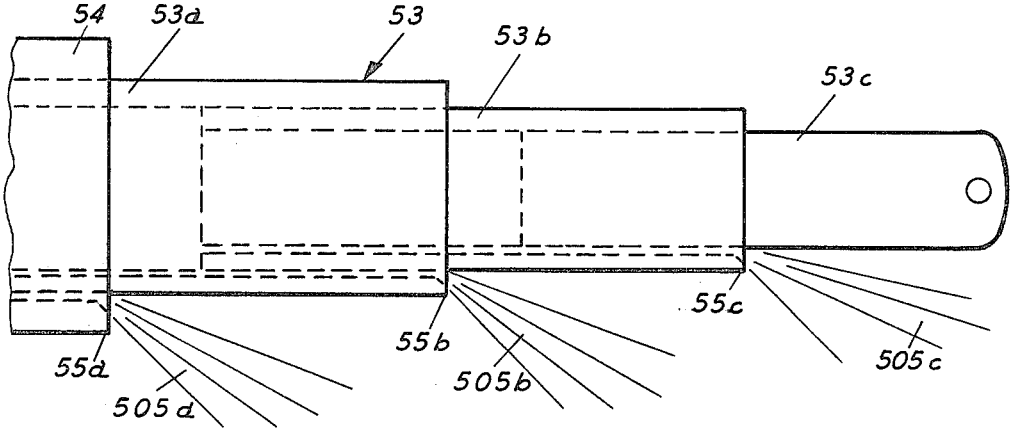
FIG. 4 is a side plane view of the telescoping rod assembly.

In typical telescoping fashion, the stages 53*a*, 53*b*, 53*c* get progressively thinner in diameter in the direction of extension of the rod 53 as shown in FIG. 4. Prior to each stage 53*a*, 53*b*, 53*c* of each telescoping rod 53, there is a transition wall of greater diameter. Each transition wall surface contains a discharge nozzle for issuance of a jet of pressurized air. The discharge nozzle is positioned in that area of the wall nearest to the sheet pile 31. The nozzles direct discrete jets of air out onto the sheet pile 31 in a downward and lateral direction in the direction of conveyance of the sheets 10 towards the backstop 32.

The telescoping rods 53 are mounted at their thickest, first stage ends from a manifold 54 supplied with a flow of pressurized air, for example from blower means, not shown. The manifold 54 is mounted upstream of the kick-off roller means 41 and substantially overlying the discharge means 58 for the airlift means 56. The thinnest, final stage ends 53*c* of the telescoping rods 53 are supported on the backstop 31, by means such as open-ended slots formed in the backstop 31. The manifold 54 may be made rotatable about its longitudinal axis 59, such that the rods 53 could be lifted out of the slots in the backstop 32. This would permit easy access to the telescoping rods 53 for repair purposes and to allow lateral adjustment of the backstop 32 along its track 33 without having to rub against surfaces of the final stage ends 53*c* of the telescoping rods 53.

Length-adjustable telescoping rod means 53 is afforded to operate in conjunction with the movable backstop 32, such that sheets of various lengths can be handled in the stacker 30. For shorter sheets, such as sheets of office stationery, the telescoping rod 53 may be collapsed and the backstop 32 moved along track 33 closer to the kick-off roller means 40. On the other hand, for longer sheets, such as legal paper, the telescoping rod means 53 can be extended and the backstop 32 moved away from the kick-off roller means 40. A constant amount of pressurized air issues from the telescoping rod means 53 against the upper surface of each sheet regardless of the length of the sheet since the position of the transition walls can be adjusted to always extend over a sheet. This ensures proper balance of the pressurized air and lift air forces regardless of sheet length.

Figure 2:
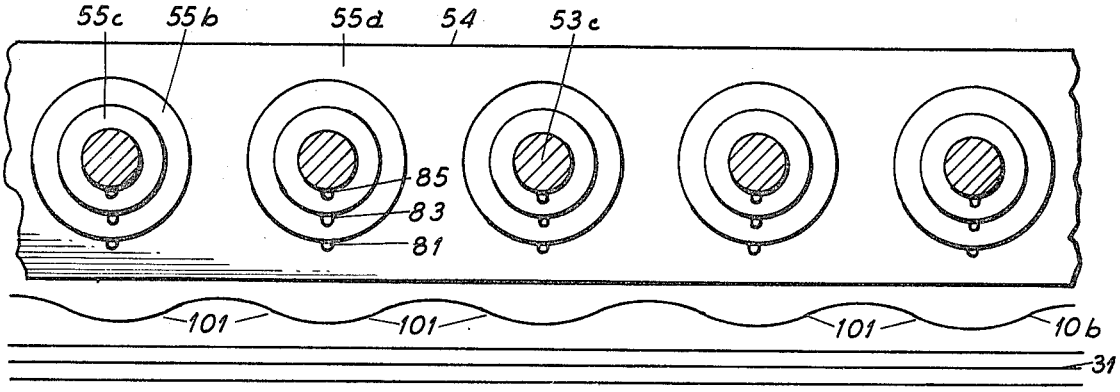
FIG. 2 is a schematic illustration of a front sectional view taken along the lines II—II of FIG. 1.

As illustrated in FIGS. 2 and 4, each rod 53 issues pressurized air in the form of a linear array of discrete jets, beginning at a point substantially over the point where lift air is being issued from discharge duct means 58 beneath the sheet and continuing on over the pile 31 to a point adjacent the backstop 32. As shown in FIG. 3, nozzles 81 are formed on a planar surface 55*a* of the manifold 54 directly below the thickest, first stages 53*a* of the telescoping rods 53. The planar surface 55*a* acts as a first stage transition wall. Nozzles 81 direct pressurized air over a discrete upper surface of each sheet substantially concurrently with the issuance of ionized air from discharge duct means 58 against the undersurface of the sheet just below the discrete upper surface.

As illustrated in FIGS. 2 and 4, nozzles 81 issue a series of first jets 505*a*. A second stage transition wall 55*b* connects the first telescope stage 53*a* with the second stage 53*b* on each rod 53. Each wall 55*b* contains a nozzle 83 which issues a second jet 505*b*. A third stage transition wall 55*c* connects the second telescope stage 53*b* with the third telescope stage 53*c* on each rod 53. Each wall 55*c* contains a nozzle 85 which issues a third jet 505*c*. The downward forces from the air jets 505*a*, *b* and *c* issued from the telescoping rod means 53 counteract against the force of air directed against the undersurface of the sheet by the airlift means 56. This interaction of vertical forces produces depressions or corrugations along discrete areas of the sheet beneath the rods 53. The corrugations thus effected are generally linear and parallel and extend in a direction perpendicular to the backstop 31, giving stiffness to the sheet. Such corrugations 101 are schematically shown in FIG. 2 as they occur to sheet 10*b*. The corrugations 101 thus effected are slight enough to enable the stacker 30 to operate with a short drop-off into the pile 31.

It is contemplated for purposes of the present invention that the force of air from a latter jet will be less than that which occurred at the previous upstream jet due to the release of air pressure through the upstream nozzle. Hence, for example, the force of air on the sheet resulting from second jets 505*b* will be less than that which occurred with the first jet 505*a*. However, the corrugative effect upon the sheet due to the influence of the latter jets will not substantially differ from that effected by the previous jets, since the counteracting lift force has also dissipated as the sheet travels further from the discharge duct means 58.

The lateral force components of the air jets 505*a*, *b* and *c*, which issue from the telescoping rods 53 serve to propel a sheet toward the backstop 32 by counteracting with the natural frictional resistance of the sheet. The use of air pressure to jog push sheets against the backstop 32 permits transport of the sheets in a high speed manner since the air flows from the lift means 56 and transporter 52 lubricates sheet travel to a far greater extent than mechanical jogging elements could be lubricated. When the sheet abuts the backstop 32 as shown by 10*b* in FIG. 1, static pressure builds along the upper surface of sheet 10*b*. It will be apparent to those skilled in the art that the sizable dynamic pressure from the jets 505*a*, *b*, and *c* is converted to static as the flow due to the jets 505*a*, *b* and *c* is obstructed by the backstop 32. At the same time, static pressure is increasing above the sheet, the counteracting lift pressure due to the air flow issued from the duct means 58 is dissipating. Although the air pressure forces from both the lift means 56 and transporter means 52 are dissipating, it will be apparent to those skilled in the art that the lift pressure, which is generally static, will dissipate more quickly than the pressure due to the jet flows 505*a*, *b*, and *c*, which is dynamic to a large extent. When the pressure above the sheet becomes greater than the lift pressure below the sheet, the sheet drops onto the pile 31. The flows from the transporter 52 and the lift means 56 are regulated by means as variable speed blowers, not shown, such that deposit onto the pile 31 occurs shortly after sheet 10*b* jogs with the backstop 32.

Operation of the piling assembly 50 of the present invention may be summarized as follows. As each sheet is advanced by the delivery conveyor belt 21 to the kick-off roller means 40, ionized air under pressure is forced upward by the lift means 56 against the undersurface of the sheet. At about the same time, first jets 505*a* of pressurized air issuing from the transporter means 52, contact the lead surface of the sheet. These jets 505*a* counteract the lift air pressure underneath the sheet along a plurality of discrete areas located beneath the telescoping rods 53 to form slight depressions or corrugations in the sheet. The corrugated sheet is propelled further out over the pile 31 due to the pushing effect of the conveyor belt means 21 along the tail end of the sheet and the combined air forces generated by the piling assembly 50. As the sheet advances to its full length out over the pile 31, the piling assembly 50 takes on greater significance in transporting the sheet to the backstop 32. The corrugated sheet floats over the sheet pile 31 carried by counteracting vertical air pressure forces at the same time it is being jogged against the backstop 31 by the lateral forces of the air jets issued from the telescoping rod means 53. Upon engagement with the backstop 32, static pressure due to the air jets acting upon the upper surface of the sheet increases while the lifting pressure dissipates, such that the sheet drops to the pile 31. The platform 60 supporting the pile 31 descends. Meanwhile, a succeeding sheet has been advanced to the kick-off roller means 40 and the process is repeated.

Although various minor modifications may be suggested by those versed in the art, it should be understood that we wish to embody within the scope of the patent warranted hereon, all such modifications as reasonably and properly come within the scope of our contribution to the art.

We claim as our invention:

1. A method of handling sheets to be stacked in a pile against a backstop, comprising:

conveying sheets seriatim upstream of said pile in a direction towards said backstop, continuously issuing pressurized air in a generally downward and lateral direction in the direction of conveyance of said sheets from means mounted directly overlying said pile directing lift air against the undersurface of each successive sheet at a point upstream of said pile as the sheet is being conveyed toward said pile, and transporting each successive sheet over said pile into jogging relationship with said backstop and depositing the sheet onto said pile with combined lift and transport forces effected by the pressurized air and lift air.

2. The method according to claim 1, further comprising:

providing said pressurized air in the form of a plurality of discrete jets arranged in a generally linear and parallel fashion extending in a direction perpendicular to said backstop.

3. The method according to claim 1, wherein said lift air is ionized.

4. The method according to claims 1 or 2, further comprising:

beginning to issue said pressurized air substantially over said point where said lift air is directed and continuing to issue said pressurized air over said pile to a point adjacent said backstop.

5. A method of using a stacker for arranging sheets in a pile, wherein said stacker includes a platform means to support said pile, a backstop means against which said pile is formed, said backstop being mounted on means such that said backstop is laterally movable in said stacker, and a piling assembly, said piling assembly comprising means for transporting successive sheets over said pile into jogging relationship with said backstop and depositing each said sheet onto said pile, said piling assembly means including a length-adjustable, telescoping rod means mounted in overlying relationship to said pile, said method comprising:

issuing pressurized air against the upper surface of each successive sheet from said telescoping rod means to assist the transport and deposit of each successive sheet and moving said backstop and adjusting said telescoping rod means to accommodate various lengths of sheet in said stacker such that a constant amount of pressurized air issues from said telescoping rod means against each sheet regardless of the sheet's length.

6. An apparatus for stacking sheets, said apparatus comprising:

a stacker means for arranging sheets in a pile, said stacker including a backstop against which said pile is formed, a platform means to support said pile, and a piling assembly for transporting successive sheets over said pile into jogging relationship with said backstop and depositing each sheet onto said pile, said piling assembly comprising:

transporter means mounted directly overlying said pile, said transporter means continuously issuing pressurized air in a generally downward and lateral direction towards said backstop, and lift means having discharge duct means for directing lift air against the undersurface of each successive sheet at a point upstream of said pile, and conveying means for advancing sheets seriatim upstream of said pile in a direction towards said backstop, whereby each sheet is contacted by said pressurized air and said lift air, transported over said pile into jogging relationship with said backstop, and deposited onto said pile by said pressurized air and said lift air.

7. The apparatus according to claim 6, wherein said lift air is ionized.

8. The apparatus according to claim 6, wherein said transporter means comprises at least one length-adjustable telescoping rod means, said rod being formed of a plurality of progressively thinner duct stages containing said pressurized air and including transition wall means leading to each said duct stage, each said transition wall including a nozzle for issuing said pressurized air in the form of a jet in said generally downward and lateral direction.

9. The apparatus according to claim 8, including a manifold means mounting a transition wall for the thickest, first stage of said at least one telescoping rod means, so that said first stage transition wall substantially overlies said discharge duct means, such that a discrete area of each successive sheet is substantially concurrently contacted by pressurized air and said lift air.

10. The apparatus according to claim 8, wherein said thinnest final stage of said at least one telescoping rod extends to adjacent said backstop and including means for making said backstop laterally movable in the direction of length-adjustability of said at least one telescoping rod.

11. A stacking apparatus for arranging sheets in a pile against a backstop, said apparatus including piling means for transporting successive sheets over said pile into jogging relationship with said backstop and depositing each said sheet onto said pile, said piling means including length-adjustable telescoping rod means mounted in overlying relationship to said pile and issuing pressurized air against the upper surface of each successive sheet to assist the transport and deposit of the sheet.

12. The apparatus according to claim 11, wherein said telescoping rod means include means issuing said pressurized air in the form of a linear array of discrete jets in a generally downward and lateral direction towards said backstop.

13. The apparatus according to claim 11 or 12, wherein said telescoping rod means comprises at least one rod extending in a substantially perpendicular relationship to said backstop and being formed of a plurality of progressively thinner duct stages containing said pressurized air such that the thinnest, final stage is situated adjacent said backstop.

* * * * *